United States Patent [19]

Graf Felix et al.

[11] 4,352,223

[45] Oct. 5, 1982

[54] WEB CRUSHING ARRANGEMENT FOR A CARD WEB

[75] Inventors: Graf Felix, Winterthur; Armin Wirz, Ossingen; Giancarlo Mondini, Winterthur, all of Switzerland

[73] Assignee: Rieter Machine Work, Ltd., Winterthur, Switzerland

[21] Appl. No.: 189,848

[22] PCT Filed: Aug. 10, 1979

[86] PCT No.: PCT/EP79/00062

§ 371 Date: Apr. 30, 1980

§ 102(e) Date: Apr. 18, 1980

[87] PCT Pub. No.: WO80/00458

PCT Pub. Date: Mar. 20, 1980

[30] Foreign Application Priority Data

Aug. 31, 1978 [CH] Switzerland ..... 9186/78

[51] Int. Cl.[3] ..... D01G 15/96

[52] U.S. Cl. ..... 19/65 CR; 19/106 R; 29/116 AD

[58] Field of Search ..... 19/65 CR, 106 R; 29/113 AD, 116 AD

[56] References Cited

U.S. PATENT DOCUMENTS

| | | | |
|---|---|---|---|
| 3,310,244 | 3/1967 | Ramo | 19/65 CR |
| 3,802,044 | 4/1974 | Spillmann et al. | 29/116 AD |
| 4,091,517 | 5/1978 | Lehmann et al. | 29/116 AD |

FOREIGN PATENT DOCUMENTS

| | | | |
|---|---|---|---|
| 904150 | 8/1954 | Fed. Rep. of Germany | 19/65 CR |
| 918676 | 9/1954 | Fed. Rep. of Germany | 19/65 CR |
| 2012837 | 3/1970 | France . | |
| 2333945 | 7/1977 | France . | |

*Primary Examiner*—Louis Rimrodt

*Attorney, Agent, or Firm*—Werner W. Kleeman

[57] ABSTRACT

A web crushing arrangement for a card web comprises cooperating working rolls (6,7) which are supported by a pressure-loadable support member (23), elastic pressure transmitting means (26,29) being provided between the working roll (7) and the support member (23). By supplying compressed air between the surface of the working roll (7) and the pressing surface (27), of the pressing slat (26) facing and shaped to be complementary to it, an air film is generated between the complementary surfaces.

13 Claims, 6 Drawing Figures

WEB CRUSHING ARRANGEMENT FOR A CARD WEB

BACKGROUND OF THE INVENTION

The present invention relates to a web crushing arrangement for a card web having cooperating working rolls, with a support member extending along one of the rolls for taking up the pressing surface, which is pressable against the roll by pressure bodies, as used in staple fibre spinning, and more particularly, in processing natural fibres.

Crushing a very thin fibre web, such as it is taken off from the doffer cylinder of a card, has as its purpose reducing the impurities, mainly the harder seed particles, by crushing them in such a manner that they impair the subsequent processing stages to a lesser degree. They also can be eliminated from the fibre material more easily.

For achieving good results using a web crushing arrangement of this type, the uniformity of the crushing pressure generated along the full working width of the roll, which is of the order of about 1 m, is of decisive importance. If the pressure is too low, the impurities are not crushed, or are not crushed sufficiently, i.e. the crush roll arrangement does not achieve the desired effect; whereas too high pressures result in damage to the fibre material. For evenly loading the crush rolls many efforts have been undertaken already; however, these have resulted in proposed solutions which are still unsatisfactory.

According to a known web crushing arrangement of the aforementioned type (German Patent PS 904'150), a uniform pressure distribution with two working rolls supported along their length is achieved by each working roll being supported on its working surface by at least one pressure-loadable support member; the support member preferentially being designed as a member of uniform stiffness.

In a further development of this solution (German Patent PS 918'676), design of the pressure transmitting element arranged between the working roll and the support member as an elastic element is also known.

The disadvantage of this crush roll arrangement is that the rotating crush roll, with its cylindrical surface, is in frictional contact with the pressure loaded support member, or with the pressure transmitting element, respectively, under the full pressure force. This causes a corresponding energy loss and presents considerable danger of damage, or of excessive wear, respectively, to the very susceptible roll surface, which, in turn, causes increased danger of lap-up formation on the working roll.

Also, maintenance and operating work on such web crushing arrangements are increased due to excessive danger of lap-formation.

SUMMARY AND OBJECTS OF THE INVENTION

It thus is an object of the present invention to propose a web crushing arrangement, which overcomes the abovementioned disadvantages of the known arrangement, and which permits generation of a uniform and easily adjustable pressure over the full width of the rolls. In particular, the proposed arrangement also eliminates any danger of lap-up formation on the working rolls and thus is provides high reliability.

This and other objects are achieved by a web crushing arrangement for a card web of the type mentioned initially by an arrangement supplying compressed air to the facing complementary pressing surface. The compressed air emerging from the compressed air supply arrangement forms an airfilm between the pressing surface and the roll, which transmits the load from the pressing surface to the roll.

In a preferred embodiment of the invention, the pressing surface is formed by a substantially rigid pressing slat, which is guided to be radially movable with respect to the surface of the working roll in the support member. The pressing slat is pressed aginst the working roll by elastic loading means.

In a further embodiment of the invention the elastic loading means are formed by a plurality of pressure springs, whereas in a further alternative design example, they consist of a pressurized chamber, known as such, arranged between the support member and the pressing slat.

According to an alternative design example the pressurized chamber is connected via bores, penetrating the pressing slat and centrally and evenly distributed therealong. The width of the pressing surface of the pressing slat in this case is larger than the one of the surface limiting the chamber, opposite to it.

Furthermore, in another embodiment of the invention, a cleaning element for cleaning the surface of the working roll in front of the entry point, as seen in the direction of rotation of the roll, is provided below the pressing surface of the pressure transmitting means.

The thickness of the airfilm, according to another characteristic of the invention, ranges between 1 $\mu$m and 100 $\mu$m.

With these and other objects, advantages and features of the invention that may become hereinafter apparent, the nature of the invention may be more clearly understood by reference to the following detailed description of the invention, the appended claims and to the several drawings attached herein.

FIG. 1 is a schematic side view of the card web delivery elements with the inventive web crushing arrangement of the present invention, FIG. 2 is a section along line II—II of FIG. 1, FIG. 3 is a more detailed section of an inventive web crushing arrangement along line III—III of FIG. 4, FIG. 4 is a section of the web crushing arrangement of the present invention according to FIG. 3, along line IV—IV of FIG. 3, FIG. 5 is an alternative embodiment of the present inventive web crushing arrangement, in a section at right angles to the working rolls, FIG. 6 is another alternative embodiment of the present web crushing arrangement, in the same section as the one according to FIG. 5.

DETAILED DESCRIPTION OF THE PREFERRED EMBODIMENT

Figure 1:
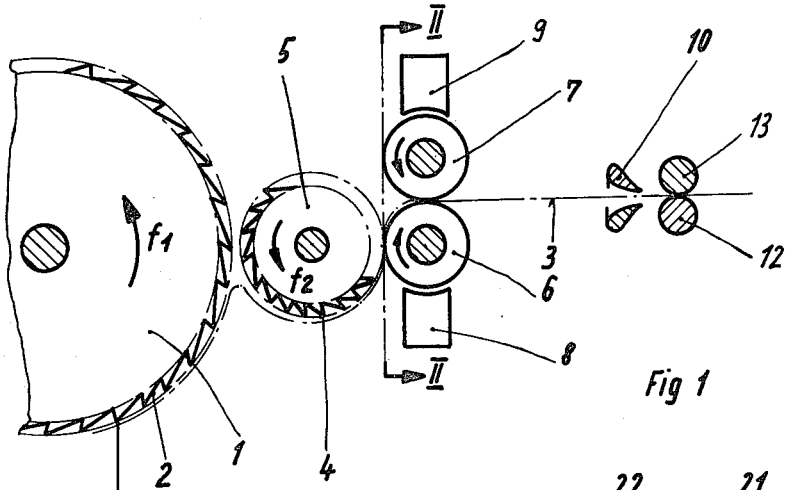
Figure 2:
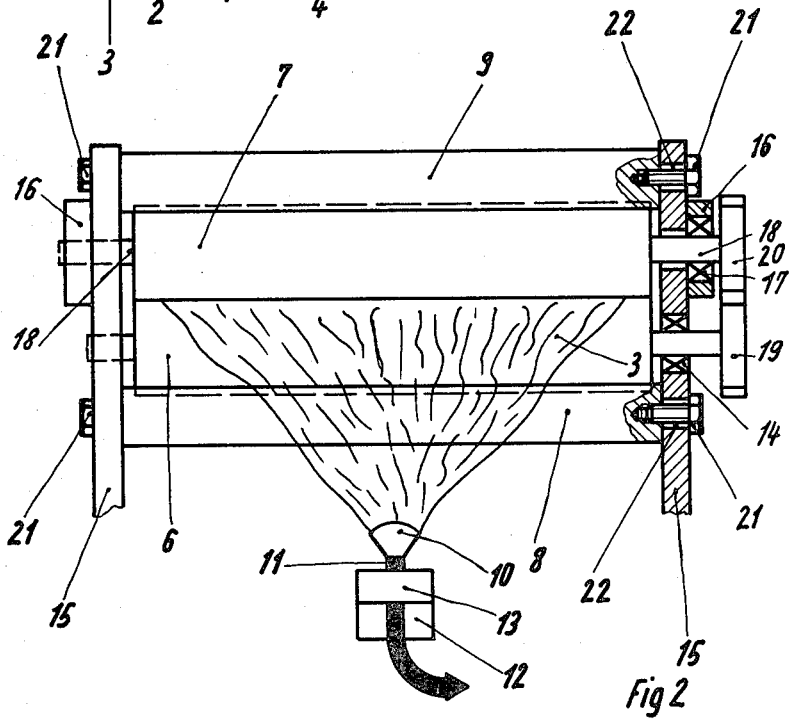

A doffer cylinder 1 (FIG. 1) of a card transports on its point clothing 2 a fibre web 3 (indicated with a dash-dotted line) from below in the rotational direction indicated by arrow $f_1$ upward to a line, where it is taken over and carried on by the point clothing 4 of a take-off roll rotating in the same direction (arrow $f_2$). The fibre web 3 is transported by the take-off roll 5 further to the right (FIG. 1) and then contacts the surface of a lower working roll 6, which cooperates with an upper working roll 7 in a nip line. The fibre web 3 passes through the nip and is crushed in the process, the technological advantages mentioned initially being effected. The web crushing arrangement is equipped with a novel loading arrangement for the working rolls 6 and 7 including the loading support members 8 and 9 schematically shown in FIGS. 1 and 2.

The fibre web 3 at the exit from the working rolls 6 and 7 is condensed by a funnel 10 into a fibre sliver 11 (FIG. 2) and is guided to the driven rolls 12, 13 of a pair of calender rolls. The lower working roll 6 (FIG. 2) is supported at both sides by antifriction bearings 14 in a fixed frame 15 of the machine (not shown in more detail), the right hand side of the frame 15 in FIG. 2 being shown in a section along a plane containing the working rolls 6 and 7 for better clarity of the figure. The upper working roll 7, however, is supported and guided for movement in a vertical plane above the roll 6 by means of antifriction bearings 17 arranged in correspondingly guided bearing supports 16. For this purpose the frame 15 at both sides is provided with correspoding openings for the axes 18 of the roll 7, which permit the movability mentioned.

The working rolls 6 and 7 are driven in any suitable manner and can e.g. be coupled via gears 19 and 20. In the inventive arrangement shown schematically in the FIGS. 1 and 2 the loading support members 8 and 9 are mounted on both sides fixedly with screws 21 to the frame 15 of the machine; in this arrangement it can prove advantageous for reasons to be explained later on if the distance between the loading support member 8, or 9 respectively, and the corresponding working roll 6, or 7 respectively, is adjustable. This is achieved in simple manner e.g. according to the solution according to FIG. 2 in such manner that the penetration openings 22 in the frame 15 for the screws 21 permit a certain adjustability, i.e. that they are correspondingly larger than the screw diameter.

The inventive web crushing arrangement concerns the pressure transmission onto one of the two working rolls 6 and 7, i.e. not necessarily both working rolls are to be loaded according to the inventive proposal.

Figure 3:
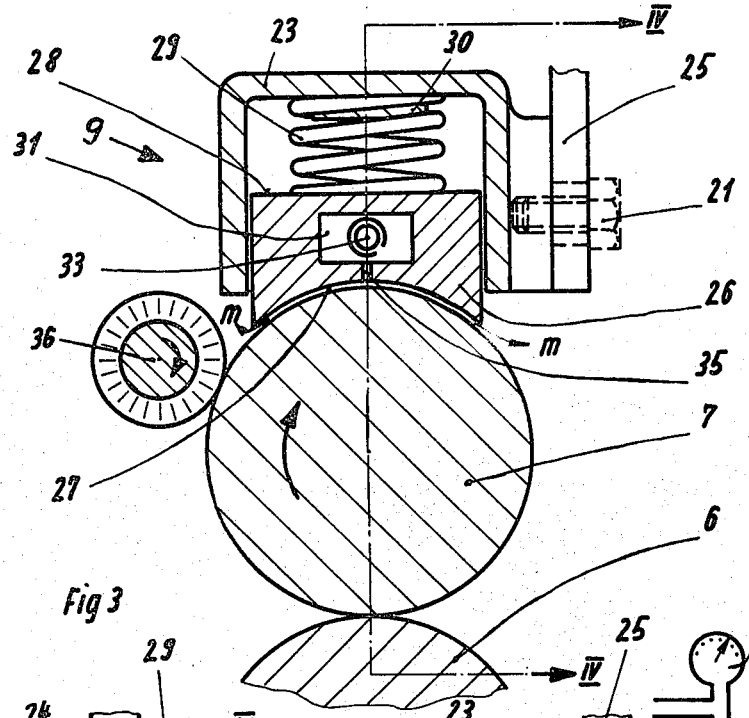
Figure 4:
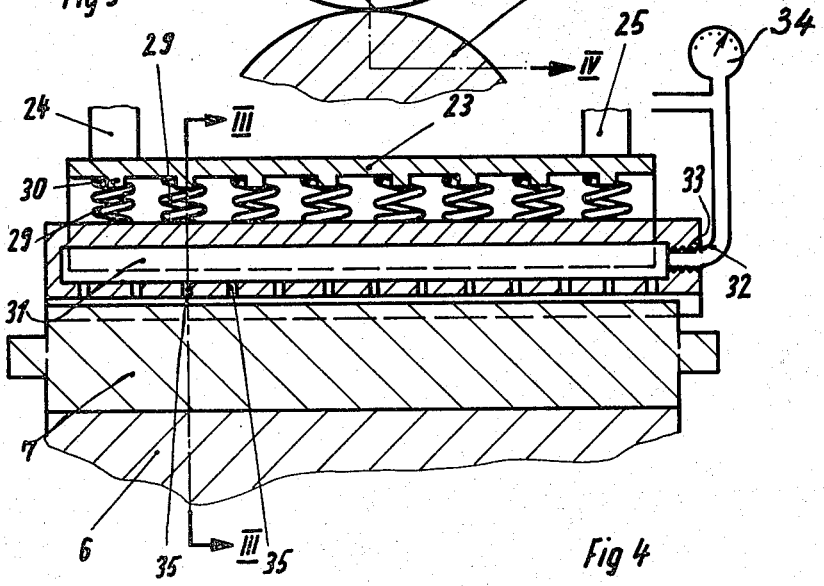

In the embodiment of the invention according to FIGS. 3 and 4 the loading support member 9 consists of a U-shaped member 23 which substantially extends over the full length of the working roll 7 and parallel to said roll. The support member 23 is mounted on two fixed support members 24 and 25, which are part of the frame 15 of FIG. 1, by screws in such manner that the height of the support member can be adjusted with respect to the working roll 7. Between the two legs of the support member 23 a substantially rigid pressing slat 26 is guided for movement in a vertical direction. The pressing slat 26 is provided with a pressing surface 27 facing the surface of the working roll 7, the form of which surface 27 is shaped to be complementary to the cylindrical shape of the roll surface. The pressing surface 27 thus also is cylindrical, and its radius substantially corresponds to the radius of the working roll 7.

The pressing slat 26 is pressed by a plurality of pressure springs 29, evenly distributed along the whole width of the working roll and arranged between the upper surface 28 of the pressing slat 26, which springs 29 act as elastic loading means, against the working roll 7. Thus the working roll 7 is loaded, i.e. the crushing pressure between the working roll 6 and 7 is generated.

The springs 29 are each guided by a cylindrical protrusion 30 extending into the interior of the helical pressure spring 29.

The loading force acting on the working roll 7 is uniformly transmitted from the pressing slat 26 to the working roll 7 due to the regularly spaced distribution of the pressure springs 29. This force can be adjusted by varying the tensioning of the pressure springs 29, which can be effected by adjusting the distance between the support member 23 and the working roll 7. This end is achieved by the adjustable mounting, already mentioned with reference to the FIGS. 1 and 2, of the loading support member 9, or of the support member 23 shown in FIGS. 3 and 4, with the screws 21.

To insure contact-free pressure transmission between the pressing surface 27 facing the surface of the working roll 7, and the surface of the working roll 7, a supporting air film is generated between said surfaces. For this purpose the pressing slat 26 is provided with a centrally arranged distribution duct 31 extending in a longitudinal direction. A compressed air duct 32 is connected to the duct 31 via a screw connection 33. The source of compressed air is not shown in the drawing. In the duct 32 e.g. a manometer 34 is also arranged, for measuring the pressure of the compressed air. Furthermore, a control valve, also not shown, may be provided in the compressed air supply system for setting the quantity, or the air pressure at the manometer 34.

The duct 31 is connected via a plurality of connecting bores 35 arranged in a row along the centre of the pressing slat 26, with the pressing surface 27. The compressed air supplied now flows through the bores 35, slightly lifting the pressing slat 26 off the surface of the working roll 7. Thus, the desired supporting air film in the gap generated between the surface of the working roll 7 and the pressing surface 27. This prevents any contact between said surfaces. The pressing slat 26 thus "floats" on the working roll 7, in such a manner that the pressure transmission from the pressing slat 26 onto the working roll 7 is effected practically friction free via the air film. The compressed air supplied is then drained at both sides of the pressing slat 26 along the very small gap to the surrounding room as indicated by the arrows m.

Of course the compressed air is to be supplied under sufficient pressure for insuring the formation of an air film of sufficient supporting power between the pressing slat 26 and the working roll 7. That is, the pressure in the air film is maintained sufficiently high to counteract the pressure exerted by the pressure spring 29 and thus lifts the pressing slat 26 slightly against the force of the pressure spring 29.

The thickness of the air film in this arrangement is set by setting the air pressure, using the manometer 34, such that it preferentially ranges between 1 μm and 100 μm. The thickness of the air film is to be chosen sufficiently large to exclude any contact between the surfaces forming the gap. Any unnecessary increase in thickness of the air film, on the other hand, implies an increased consumption of compressed air and thus is to be avoided.

The optimum thickness of the air film depends upon the type of the surface of the working roll 7 and of the pressing surface 27. The smoother the surfaces are, the thinner the air film can be chosen, which results in considerable savings in compressed air consumption.

In the web crushing arrangement shown in FIGS. 3 and 4, the pressure force exerted by the elastic loading means, i.e. by the pressure springs 29, onto the pressing slat 26 can thus be set independently from the pressure of the compressed air supplied by the compressed air supply system. In practical use, the pressing force is chosen first, according to the technological requirements, and subsequently the pressure of the compressed air is chosen such that an air film as thin as possible, but coherent, is generated such that no contact between the working roll 7 and the pressing slat 26 can occur. Owing to the almost friction-free pressure transmission, only very small moments are required for driving the working rolls 6 and 7, with the load on the corresponding bearings being reduced. Thus not only the wear is reduced but also the power consumption.

In order to improve the reliability of the web-crushing arrangement, it can prove advantageous to clean the surface of the working roll 7 immediately before it reaches the pressing surface 27 using a cleaning element for eliminating any contamination. Such contaminations, which in the process of crushing seed particles in the web easily cling to the surface of the working roll, can locally disrupt the very thin air film, such that the contact-free pressure transmission between the pressing slat 26 and the working roll 7 is no longer locally insured.

The cleaning element, which in the embodiments shown in FIGS. 3 and 4 is designed as a rotating brush 36, completely cleans the roll surface and thus insures that optimum conditions of pressure transmission are maintained.

Figure 5:
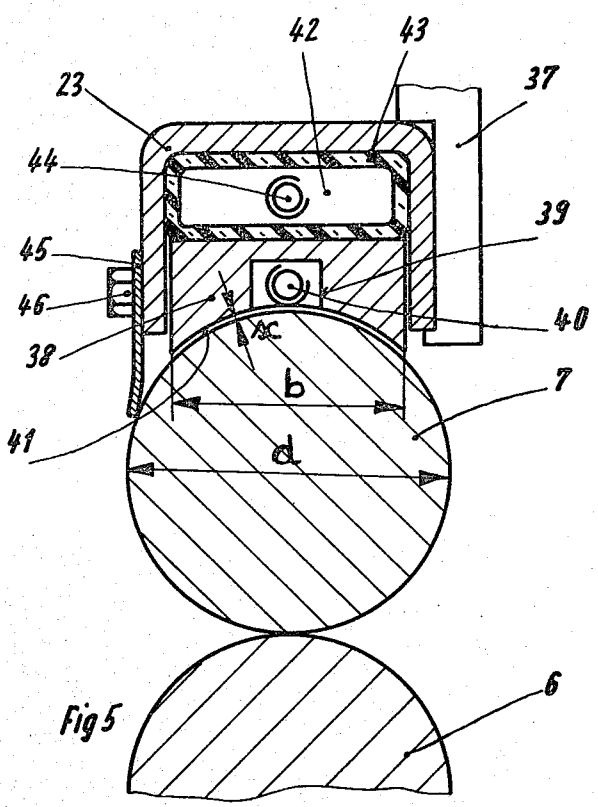

As a supporting member in an alternative embodiment according to FIG. 5, the U-shaped support member 23 is used, which, however, in this arrangement is not adjustable in height with respect to the working roll 7, i.e. it is rigidly mounted on the support members 37 (one only being shown) of the frame of a machine.

A pressing slat 38 is provided with a distribution duct 39 for the compressed air supplied via a supply opening 40 arranged at one end. It is provided in the surface of the pressing surface 41. Generation of the air film between the pressure slat 38 and the working roll is effected here in exactly the same manner as in the aforementioned arrangement according to FIGS. 3 and 4. The compressed air is evenly distributed along the full width of the roll via the distribution duct 39. In this embodiment the elastic loading means consists of a pressurized chamber 42 arranged between the support member 23 and the pressing slat 38, which chamber 42 in the particular embodiment according to FIG. 5 consists of a closed, pressurized hose, the cross-section of which is deformable. Via a supply duct 44 (of which the connecting portion only is shown in FIG. 5) the chamber 42 is pressurized which effects loading of the pressing slat 38. The solution shown here with the deformable hose 43 presents the particular advantage that the chamber 42 is completely sealed in a simple manner from the surrounding room, in such manner that the choice of the pressure medium (e.g. air) is free.

In the solution according to FIG. 5 the pressure force exerted onto the pressing slat 38 can be set by setting the pressure in the chamber 42, whereas by setting the pressure of the compressed air supplied via the supply opening 40 the thickness of the air film can be set optimally and independently from the pressure in the chamber 42.

The advantage of the web crushing arrangement shown in FIG. 5 over the one according to FIGS. 3 and 4 is seen in the easier and more precise adjustability of the pressure force as the support member 23 can be mounted fixedly with respect to the room and thus can be mounted more precisely and predominantly unchangeably on the support members 37.

In FIG. 5, another solution is shown for a device for cleaning the working roll 7. Here a grazing blade 45, known and proven as such, is used, which is mounted onto the front leg of the support member 23 using screws 46.

Figure 6:
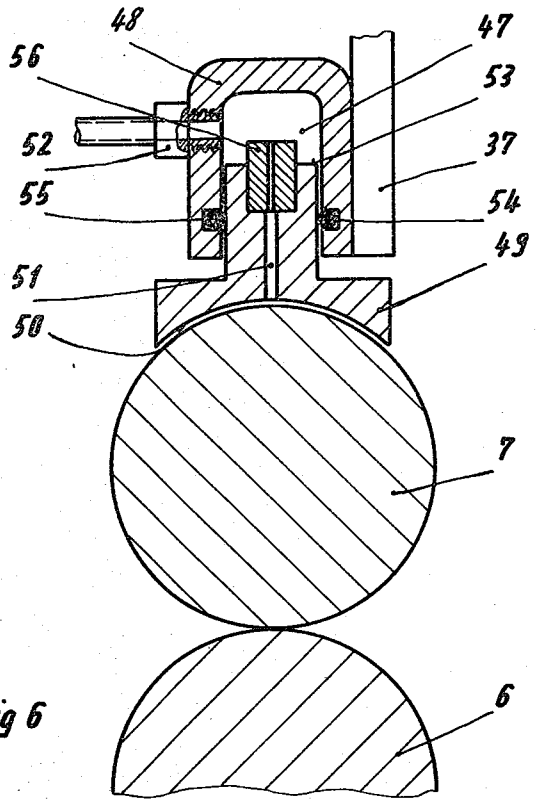

In FIG. 6 a further embodiment of the web crushing arrangement is shown, which differs mainly in its simplicity from the already described embodiments shown in FIGS. 2 through 5. A chamber 47 is formed by a U-shaped support member 48 and a pressing slat 49 is arranged movably therein. The support member 48 in turn is rigidly mounted on supports 37 (one only being shown) of a frame of the machine. The pressing slat 49 in this arrangement is of an inverse T cross-section, i.e. it is smaller in its upper portion, where it is guided to be vertically movable by the vertical legs of the support members 48, than in its lower portion, which contains the pressing surface 50 shaped to be complementary to the surface of the roll 7 which it faces. Furthermore, in the pressing slat 49, a row of bores is arranged evenly spaced over the full width of the working roll and at the centre of the slat 49 (one bore 51 only being shown), which bores 51 thus connect the pressurized chamber 47 in which a pneumatic pressure is contained (the pressure being generated via the compressed air supply duct 52) with the complementary surface 50 of the pressing slat 49.

The web crushing arrangement according to FIG. 6 functions, in principle similarly to the arrangement described with reference to FIG. 4. A difference is that, in this arrangement, the same compressed air is used for generating the air film between the pressing slat 49 and the working roll 7, as is used for generating the pressure in the chamber 47, and, thus, for generating the pressing force acting on the pressing slat 49. Using this arrangement in comparison with the arrangement shown in FIG. 5, one compressed air supply duct can be eliminated. Of course, the arrangement according to FIG. 6 can function only if the air film between the pressing slat 49 and the working roll 7 is capable of lifting the pressing slat 49 slightly; the pressing action of the pressure in the chamber 47 being overcome. This in turn is only possible if the complementary pressing surface 50 is larger than the upper surface 53 of the pressing slat 49. For operating the arrangement without unnecessary air losses, it is advisable to equip the pressing slat 49 with seals 54 and 55 with respect to the vertical guide legs of the support member 48. Furthermore, it can prove advantageous in this arrangement to adapt the diameter of the bores 51 to the pressing force technologically required between the working rolls 6 and 7 by inserting exchangeable sleeves 56 (one only being shown) of different diameters. Thus, by using this simple design, a minimum thickness of the air film between the pressing slat 49 and the working roll 7 can be established for operation.

It also can prove advantageous for all embodiments of the present inventive web crushing arrangement shown, if the pressing slats 26 (FIGS. 3 and 4), 38 (FIG. 5) and 49 (FIG. 6) are made from a material having a low coefficient of friction with respect to the metallic working roll 6 or 7 respectively, such as e.g. polyamide, as thus any local contact eventually occuring between the pressing slat and the working roll results in lower deceleration of the working roll. Also, the emergency operating conditions are thus improved.

The dimensions of the elements of the web crushing arrangement chosen and the pressures required of course depend on the effect desired (intensity of the desired crushing effect) and of the other dimensions of the machine (width of the web to be crushed), as well as of other characteristics (such as the precision and quality, i.e. surface roughness of the working rolls).

As solely an example, the dimensions and pressures, applied with very good results in web crushing arrangement of the type shown in FIG. 5, are cited in the following.

The arrangement was equipped with two working rolls 6 and 7 of a diameter of 80 mm and of a length of 1040 mm. The width b of the pressing slat 38 was of 48 mm. The surface of the working roll was chromed and ground.

Using these dimensions the arrangement was operated, for achieving a pressure between the working rolls 6 and 7 of 1,5 kg/cm (optimum for effectively crushing the fibre web) at an above-atmospheric pressure in the hose 43, an in the chamber 42 respectively, of 0,18 bar.

Compressed air was supplied into the distributing duct 39 of the pressing slat 38 via the supply opening at an above-atmospheric pressure of 0,4 bar. Under these conditions, an air film was generated between the surface of the working roll 7 and the complementary surface 41 of the thickness x of about 30 μm, via which the loading force of the chamber 42 is transmitted contact-free onto the surface of the working roll 7. The air consumption was measured at about 40 Nl/min.

The advantages of the inventive web crushing arrangement are summarized as follows:

(a) optimum evenness of the crushing action along the full width of the working rolls, the deflection problem of the rolls being eliminated completely, (b) preservation of the surface of the working rolls owing to the contact-free pressure-transmission using an air film, (c) complete relief of load from the bearing and the drive mechanism of the roll; owing to the absence of any friction, the drive power consumption of the roll is almost negligible, owing to which, and in spite of the use of compressed air for generating the air film, the total power consumption can remain unchanged compared with a conventional web crushing roll arrangement, (d) owing to the advantageous force conditions, the whole design of the web crushing arrangement is simple and economically feasible in its conception (as the corresponding elements of the machine can be built lighter), and more reliable operation is achieved. Also, retrofitting of the crush roll arrangement to existing machines is possible without complications.

Although only a preferred embodiment is specifically illustrated and described herein, it will be appreciated that many modifications and variations of the present invention are possible in light of the above teachings and within the purview of the appended claims without departing from the spirit and intended scope of the invention.

We claim:

1. Web crushing apparatus for a card web comprising cooperating rolls, a pressing member which is pressable against one roll with facing complementary surfaces on the pressing member and the roll, and means for supplying air under pressure to the facing complementary pressing surfaces on the whole length of the rolls such that due to compressed air supplied, an air film is formed between the pressing member and the one roll, which film transmits the load from the pressing member to the roll and wherein the pressing member is formed by a substantially rigid member which is guided for radial movement with respect to the one roll and which is pressed against the one roll by resilient loading means.

2. Web crushing apparatus according to claim 1, wherein the resilient loading means comprises a plurality of pressure springs evenly distributed along the whole length of the one roll.

3. Web crushing apparatus according to claim 1, wherein the resilient loading means comprises a pressurizable chamber between the pressing member and a support therefor.

4. Web crushing apparatus according to claims 1, 2 or 3 wherein the pressing member is provided with a distribution duct extending in the longitudinal direction, for the supply of compressed air which duct is in communication with the pressing surface of the pressing member.

5. Web crushing apparatus according to claim 4, wherein the distribution duct opens directly onto the pressing surface of the pressing member.

6. Web crushing apparatus according to claim 4, wherein the distribution duct is connected with the pressing surface of the pressing member via a plurality of connecting bores arranged centrally with respect to the pressing member and spaced at regular intervals along the length thereof.

7. Web crushing apparatus according to claims 2 or 3, wherein separate setting means are provided for the resilient loading means and for setting the pressure of the compressed air, using which the pressure force exerted by the loading means onto the pressing member can be set separately from the pressure of the compressed air supplied via the supply means.

8. Web crushing apparatus according to claim 3, wherein the pressurizable chamber is connected with the pressing surface of the pressing member via bores which penetrate the pressing member and are evenly distributed along, and centrally with respect to the pressing member, and that the area of the pressing surface of the pressing member is larger than the area of that surface of the pressure member limiting the chamber and subjected in use to a force opposing the force on the pressing surface.

9. Web crushing apparatus according to claim 1, wherein a cleaning element is provided for cleaning the surface of the one working roll immediately before it reaches the pressing surface on said pressing member.

10. Web crushing apparatus according to claim 9, wherein the cleaning element is a stationary blade.

11. Web crushing apparatus according to claim 1, wherein the pressing member is made of a material which has a low coefficient of friction with respect to the one roll.

12. Web crushing apparatus according to claim 11, wherein the pressing member is made of a polyamide material and the roll is metallic.

13. Web crushing apparatus according to claim 1, wherein in use an air film of a thickness ranging from 1 μm to 100 μm is created between the pressing member and the one roll.

* * * * *